United States Patent [19]

Gay et al.

[11] Patent Number: 4,579,069

[45] Date of Patent: Apr. 1, 1986

[54] VOLUME REDUCTION OF LOW-LEVEL RADIOACTIVE WASTES

[75] Inventors: Richard L. Gay, Canoga Park; LeRoy F. Grantham, Calabasas, both of Calif.

[73] Assignee: Rockwell International Corporation, El Segundo, Calif.

[21] Appl. No.: 467,272

[22] Filed: Feb. 17, 1983

[51] Int. Cl.[4] ..... F23B 7/00

[52] U.S. Cl. ..... 110/342; 34/10; 34/57 R; 55/259; 110/216; 110/224; 110/237; 110/238; 110/346; 110/348; 159/48.1; 159/DIG. 12; 159/4.02; 423/242

[58] Field of Search ..... 110/216, 218, 224, 236, 110/237, 238, 243, 260, 342, 344, 346, 348; 55/DIG. 9, 90, 230, 259; 159/4 A, 48.1, DIG. 12; 34/10, 57 R, 57 D; 432/14; 423/242 R, 242 A, 244 R, 244 A, 22

[56] References Cited

U.S. PATENT DOCUMENTS

| | | | |
|---|---|---|---|
| 3,008,904 | 11/1961 | Johnson, Jr. et al. | 159/DIG. 12 |
| 3,101,258 | 8/1963 | Johnson | 23/277 |
| 3,848,548 | 11/1974 | Bolejack, Jr. et al. | 110/237 |
| 3,885,918 | 5/1975 | Isahaya | 423/242 A |
| 3,922,974 | 12/1975 | Hempelmann | 110/237 |
| 3,954,381 | 5/1976 | Marecaux | 110/238 |
| 4,002,524 | 1/1977 | Damgaard-Iversen et al. | 159/48.1 |
| 4,145,396 | 3/1979 | Grantham | 423/22 |
| 4,197,278 | 4/1980 | Gehri et al. | 423/242 A |
| 4,236,464 | 12/1980 | Anderson et al. | 110/238 |
| 4,246,242 | 1/1981 | Butler et al. | 159/4 A |
| 4,277,362 | 7/1981 | Mallek et al. | 110/237 |
| 4,314,877 | 2/1982 | Queiser et al. | 159/DIG. 12 |
| 4,499,833 | 2/1985 | Grantham | 110/237 |

*Primary Examiner*—Henry C. Yuen
*Assistant Examiner*—Steven E. Warner
*Attorney, Agent, or Firm*—H. Fredrick Hamann; Clark E. DeLarvin

[57] ABSTRACT

The volume of low-level radioactive wastes containing free water is reduced by introducing the waste as a finely atomized spray into a zone heated by means of a hot gas. Contact of the spray particles with the hot gas results in the production of a dry, flowable radioactive solid product and a gaseous non-radioactive product which contains substantially no $NO_x$ or $SO_x$ and no volatile radionuclides, which are retained in the solid product.

23 Claims, 1 Drawing Figure

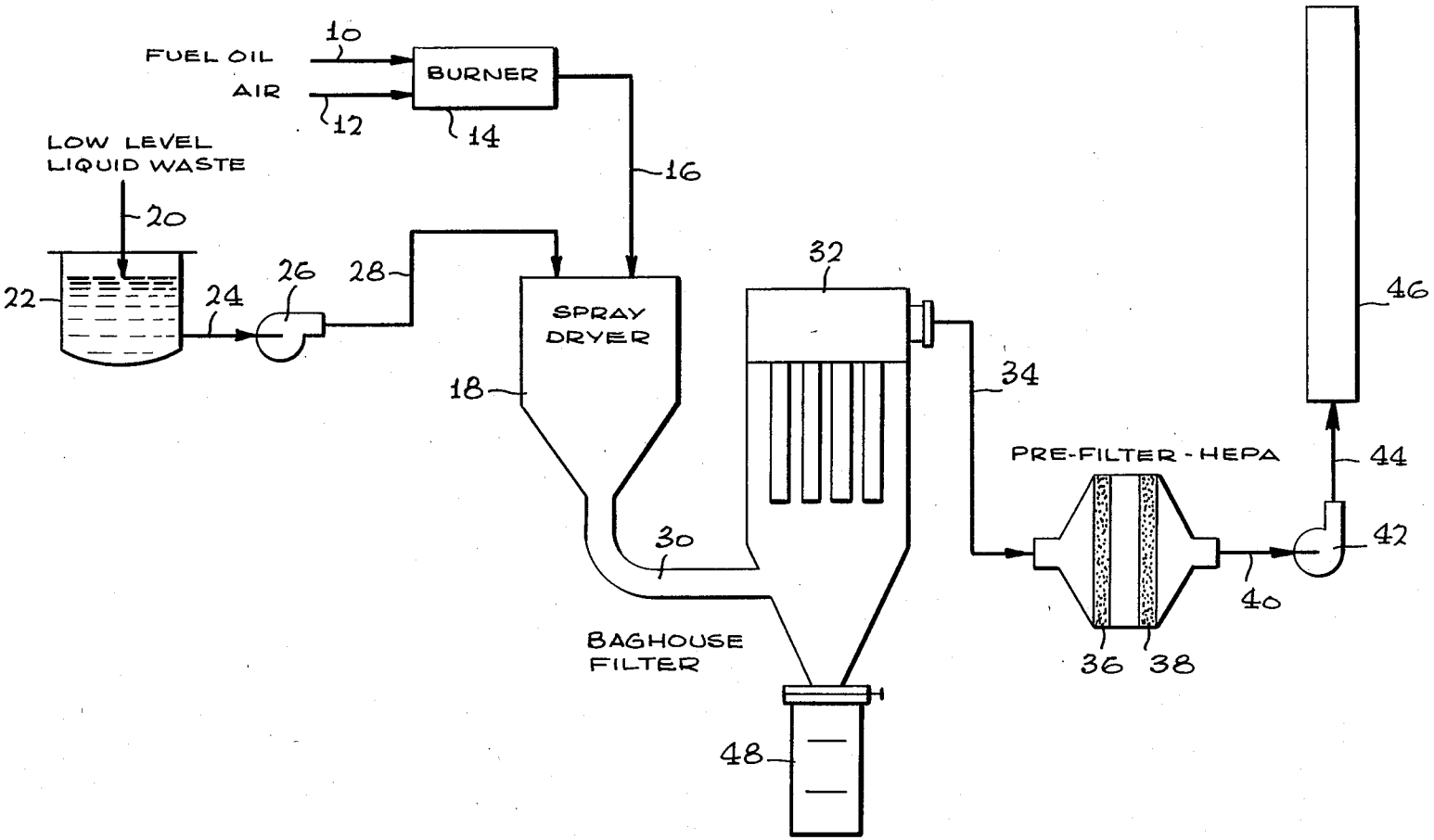
FUEL OIL
AIR
BURNER
LOW LEVEL
LIQUID WASTE
SPRAY
DRYER
PRE-FILTER - HEPA
BAGHOUSE
FILTER
10
12
14
16
18
20
22
24
26
28
30
32
34
36
38
40
42
44
46
48

VOLUME REDUCTION OF LOW-LEVEL RADIOACTIVE WASTES

BACKGROUND OF THE INVENTION

1. Field of the Invention

This invention relates to waste management and more particularly to the volume reduction of wastes. In one of its more particular aspects this invention relates to a process for reducing the volume of low-level radioactive wastes. In another of its more particular aspects, this invention relates to a process for producing dry, flowable solids from liquid wastes.

2. Prior Art

Waste management frequently involves the necessity of disposing of large volumes of materials, some of which may be contaminated with hazardous substances. In nuclear power plants, for example, large amounts of radioactive liquid and solid wastes, known as low-level radioactive wastes, are produced. Low-level radioactive wastes differ from high-level radioactive wastes, which are produced in the reprocessing of nuclear fuels, in that the latter present greater risks of contamination and therefore require disposal techniques which are more stringent than in the case of low-level radioactive wastes. Disposal of radioactive wastes in general cannot be readily accomplished by using conventional waste disposal techniques. Because of the relatively long half-lives of certain radioactive elements, the most widely used disposal techniques are storage, solidification and burial. The expense of so disposing of large volumes of radioactive wastes, however, is constantly rising and approaching levels at which volume reduction becomes economically desirable.

Many efforts have been directed at reducing the volume of radioactive wastes.

U.S. Pat. No. 3,101,258 describes a heated-wall spray calcination reactor useful for disposing of nuclear reactor waste solutions. In spray calcination reactors of the heated-wall type, however, the temperature gradient from the outside of the reactor inward may result in uneven heating, producing regions of undesired high temperatures and causing non-uniform results.

U.S. Pat. No. 3,922,974 discloses a hot air-fired furnace for incinerating radioactive wastes. The use of this apparatus, however, results in the production of noxious off-gases which require additional processing for removal.

U.S. Pat. No. 4,145,396 describes a process for reducing the volume of organic waste material contaminated with at least one volatile compound-forming radioactive element selected from the group consisting of strontium, cesium, iodine and ruthenium. The selected element is fixed in an inert salt by introducing the organic waste and a source of oxygen into a molten salt bath maintained at an elevated temperature to produce solid and gaseous reaction products. The molten salt bath comprises one or more alkali metal carbonates and may optionally include from 1 to about 25 wt. % of an alkali metal sulfate. Although effective to some extent in reducing the volume of organic wastes, further volume reduction involving the separation of the radioactive materials from the non-radioactive components of the molten salt bath requires a number of additional processing steps.

In U.S. patent application Ser. No. 451,516, filed Dec. 20, 1982 and assigned to the assignee of the present invention, there is proposed a process for converting radioactive wastes in the form of liquids, solids and slurries into a mixture of a non-radioactive gas and a radioactive inorganic ash. In accordance with that process the radioactive waste is introduced as a finely atomized spray into a zone heated by means of a hot gas to a temperature sufficient to effect the desired conversion, preferably a temperature in the range of about 600° to 850° C. The process is conducted in a spray dryer modified to combust or calcine the waste.

While the foregoing patent application discloses a process which is satisfactory for destroying radioactive wastes, the high temperatures utilized in the process can produce noxious gases such as $NO_x$ or $SO_x$, the removal of which necessitates taking additional measures to ensure that any gas ultimately released to the atmosphere is non-polluting. In addition, such high temperatures may cause the volatilization of radionuclides from the radioactive waste.

Consequently, there is a need for a process which can be used to reduce the volume of radioactive wastes without producing noxious off-gases or volatilizing radionuclides. This need is particularly pronounced in the case of liquid low-level radioactive wastes where large volumes of wastes of relatively low radioactivity compound the problems and costs involved in their transportation and disposal.

OBJECTS OF THE INVENTION

It is accordingly an object of this invention to provide a process which is capable of reducing the volume of low-level radioactive wastes.

Another object of this invention is to provide such a process which is safe, efficient and inexpensive.

Another object of this invention is to provide a process for converting a liquid waste into a solid material of reduced volume which is more readily transported and disposed of than liquid waste.

Another object of this invention is to provide a process which is adaptable to liquids, slurries and wet solids.

Another object of this invention is to provide a process which is capable of reducing the volume of low-level radioactive wastes without producing noxious off-gases.

Another object of this invention is to provide a process which is capable of reducing the volume of low-level radioactive wastes without volatilizing radionuclides.

Other objects and advantages of this invention will become apparent in the course of the following detailed description.

SUMMARY OF INVENTION

In general, the present invention provides a process for reducing the volume of a low-level radioactive waste by, in essence, removing the water from the waste by spray drying in a uniform temperature zone and producing a dry, flowable solid product containing the radioactive materials, which is readily disposed of. The process comprises introducing the waste in the form of a finely atomized spray into a zone heated, by means of a hot gas contained within the zone, to a temperature sufficient to vaporize the water contained in the waste but insufficient to produce any oxidation products of the waste or to volatilize any radionuclides therefrom. A dry, flowable, radioactive solid product is produced, together with a gaseous product comprising water vapor and containing substantially no $NO_x$ or $SO_x$ and no volatile radionuclides. The gaseous product, after suitable purification to remove particulates, is sufficiently non-polluting to be released to the atmosphere.

The solid product, which is reduced in volume compared to the volume of the waste material, is readily disposable by conventional means such as storage or burial or incorporation into a solid matrix such as a glass, ceramic, polymeric or concrete matrix prior to storage or burial.

The ratio of the volume of the low-level radioactive waste to the dry, flowable radioactive solid product is in the range of about 2:1 to 3.5:1. The ratio of waste to solid product can be further increased to about 10:1 or higher by compacting the dry, flowable solid product at various compressions.

BRIEF DESCRIPTION OF THE DRAWING

The sole FIGURE of the drawing is a schematic flow diagram illustrating an embodiment of the process of the present invention.

DESCRIPTION OF THE PREFERRED EMBODIMENTS

The process of the present invention accomplishes volume reduction of low-level radioactive wastes which contain free water by contacting such waste in the form of a finely atomized spray with a hot gas to vaporize the water from the waste. A suitable apparatus in which to carry out the process of this invention is a heated gas spray dryer. In general, the hot gas is produced by burning a suitable gaseous, liquid or solid fuel with an excess of an oxygen-containing gas such as air, oxygen-enriched air or oxygen in a suitable burner. The resulting hot gas is then introduced into the spray dryer at a rate to provide the desired temperature in the spray dryer. Any combustible gas, such as natural gas or propane; liquid, such as fuel oil or kerosene; or solid fuel, such as coal or coke, may be used in such a burner. Fuel oil is preferred as the fuel because of its lower cost and convenience. In any case, the hot gas which contacts the waste consists of a mixture of the oxidation products of the fuel used as well as any unreacted oxygen or air, depending upon the oxygen-containing gas selected.

The temperature of the spray drying zone is uniformly maintained in the range of about 45° to 300° C. and preferably about 65° to 205° C. by varying the rate of feeding the hot gas into the spray dryer. Temperatures above about 300° C. result in undesired oxidation and destruction of the spray-dried waste and the production of noxious off-gases or the unwanted volatilization of radionuclides. The upper temperature limit is also constrained by the equipment used for particulate removal. At outlet temperatures below about 45° C. the solid product is not completely dry. It is therefore important that the temperature in the spray drying zone be uniform so as to avoid the occurrence of unusually hot or unusually cold areas within the zone.

A finely atomized spray of the low-level radioactive waste being treated is introduced into the spray drying zone by means of a suitable spray nozzle or other distribution means. The necessary degree of atomization can be achieved with all forms of waste except dry solids. Solutions and slurries are readily atomized without further treatment. Wastes containing wet solids such as ion exchange resins can be atomized if the solids are finely divided and slurried in aqueous solution prior to spraying.

Various types of aqueous low-level radioactive wastes can be treated in accordance with the process of the present invention to achieve substantial reductions in volume. For example, wastes from a boiling water reactor (BWR) include solutions such as are used in cleaning up radioactive spills and decontaminating surfaces. Wastes from a pressurized water reactor (PWR) include aqueous solutions of boric acid or borate salts used as burnable neutron poisons in the primary reactor coolant. Aqueous slurries of ion exchange resins and filter aids contaminated with radioactive corrosion products and fission products of various types are common to both types of wastes.

Spray drying of any of the above or any other low-level radioactive wastes, such as sludges, results in the production of a dry, flowable solid which contains the radioactive contaminants and a non-radioactive gas which, after filtering, can be released to the atmosphere as a non-polluting gas.

Referring now to the drawing, the sole FIGURE of which illustrates the spray drying of a low-level radioactive liquid waste, fuel oil and air are introduced into a burner 14 via conduits 10 and 12, respectively. Heated air from burner 14 is introduced into a heated gas spray dryer 18 via a conduit 16. Liquid waste is introduced into a feed tank 22 via a conduit 20 and metered via a conduit 24, a metering pump 26, and a conduit 28 to heated gas spray dryer 18. At the bottom of heated gas spray dryer 18 the solid and gaseous products are removed via a conduit 30 to a baghouse filter 32, and the filtered gases are removed via a conduit 34 to a prefilter 36 and a HEPA filter 38. After fine filtering, the purified gas is conducted to a plant stack 46 via a conduit 40, a fan 42, and a conduit 44. Solid product from baghouse filter 32 is collected in a closed container 48.

The process of the present invention has many advantages. The waste to be processed requires no pretreatment, such as pH adjustment, in order to be dried. The spray drying process described above is not composition dependent and can handle virtually any feed material that will produce a dry product.

Although the process is carried out in an oxidizing atmosphere by utilizing an excess of an oxygen-containing gas, the solids produced are not decomposed or burned. This result is achieved by operating the spray dryer at an inlet temperature which is below the combustion or decomposition temperature of the waste fed to the spray dryer, yet sufficiently high to assure that the material processed leaves the spray dryer in the form of a uniformlY dry product.

The temperature at which the spray dryer is operated is as close as possible to the dew point yet high enough to accomplish the desired uniform drying of waste. Economies in operation costs and in the materials of construction of the spray dryer are thereby realized.

At the low temperatures of operation of the spray dryer in the process of the present invention, partial oxidation of the waste is avoided. Ion exchange resins, for example, comprised of nitrogen-containing or sulfur-containing groups are completely dried without releasing $NO_x$ or $SO_x$, which would be formed upon partial oxidation of the ion exchange resins.

Volatile fission products such as compounds of cesium or iodine are contained in the solid product and not volatilized in the off-gases of the process.

The solid product of the process of this invention is a dry, flowable powder which is readily transported to disposal drums, immobilized in a monolith in a solidification system, or compressed in drums using equipment which is similar to conventional equipment used to compress solid radioactive wastes.

These advantages are unique to the process of the present invention and provide an alternative to volume reduction processes currently in use, such as partial evaporation and solidification of liquids.

The invention may be better understood by reference to the following examples which are intended to be illustrative of the process of the present invention and not in any way limitative thereof.

EXAMPLE 1

Three non-radioactive simulated low-level wastes having compositions shown in Table I were spray dried and filtered in a system similar to that shown in the drawing.

TABLE I

| Component (kg) | Waste Compositions: Simulated BWR Waste | Simulated PWR Waste | Resin-Filter Aid Waste |
|---|---|---|---|
| $Na_2SO_4$, anhyd. | 176 | 0.0 | 0.0 |
| $H_3BO_3$ | 0.0 | 90.7 | 0.0 |
| Anion resin[1] | 0.0 | 0.0 | 6.0 |
| Cation resin[2] | 0.0 | 0.0 | 7.0 |
| Precoat[3] | 0.0 | 0.0 | 59.1 |
| Precoat[4] | 0.0 | 0.0 | 55.8 |
| $Na_3PO_4.12H_2O$ | 9.1 | 7.94 | 0.0 |
| $CsNO_3$ | 0.5335 | 0.4440 | 0.2524 |
| $Co(NO_3)_2.6H_2O$ | 1.7957 | 1.4964 | 0.8501 |
| $Mn(NO_3)_6$ (51.7 wt. % solution) | 0.0 | 1.9099 | 1.0844 |
| $Fe(NO_3)_3.9H_2O$ | 2.2675 | 1.8901 | 1.0847 |
| NaI | 0.4291 | 0.3576 | 0.2031 |
| $H_2O$ | 664 | 652 | 296 |

[1]Powdex PAO anion exchange resin
[2]Powdex PCH cation exchange resin
[3]Ecodex X-202-H precoat: 38% Powdex PAO, 29% Powdex PCH, 33% fiber filter aid
[4]Ecodex X-203-H precoat: 25% Powdex PAO, 25% Powdex PCH, 50% fiber filter aid The simulated BWR waste, nominally a 20 wt. % sodium sulfate solution, contained $Na_2SO_4$ and $Na_3PO_4.12H_2O$. The simulated PWR waste, nominally a 12 wt. % boric acid slurry, contained $H_3BO_3$ and $Na_3PO_4.12H_2O$. The resin filter aid waste contained slurries of anion exchange resin, cation exchange resin and two precoats, which are mixtures of anion exchange resin, cation exchange resin and filter aid.

Each of the waste samples was spiked with small concentrations of non-radioactive manganese nitrate, cobalt nitrate and ferric nitrate, simulating radioactive corrosion products, and with non-radioactive cesium nitrate and sodium iodide, simulating radioactive fission products. The cesium concentration corresponded to 35,000–40,000 μCi/cc of Cs-137.

The system consisted of a 2.1-m-diameter spray dryer and a pulse-jet baghouse filter. The spray dryer was a standard Bowen model constructed of carbon steel equipped with a 7.5-kW Bowen Model AA-6 spray machine and a 15-cm-diameter Type DH centrifugal atomizer. Atomizer speed was normally maintained at 22,000 rpm. From the spray dryer, the exhaust gases with their entrained solids were piped directly to the baghouse collector. The baghouse was a pulse-jet design containing 64 outside-collecting polyester bags, each 15 cm in diameter and 3 m long. The bags were suspended in an 8×8 array. Cleaning was accomplished by a reverse pulse of compressed air initiated by a solenoid signal directed to one row of bags at a time. Each cleaning pulse was 20 msec in duration at 15-sec intervals. An 18.6-kW New York blower induced-draft fan was used to pull hot gas from an excess-air natural gas burner through the spray dryer/baghouse system.

Sampling locations for gas analyses were at the spray dryer inlet at a point before any feed enters the spray dryer, the spray dryer outlet, the baghouse inlet, and the baghouse outlet. Sulfur dioxide measurements were performed with a Teledyne spectrophotometric analyzer. $NO_x$ measurements were made with a Monitor Labs chemiluminescence analyzer. The temperatures at various points in the system were monitored with Type K (Chromel-Alumel) thermocouples, whose outputs were shown on digital displays and recorded on a multipoint strip chart recorder. The gas flow rates were determined by standard pitot tube traverse flow measurements. Pressures were measured with Magnehelic differential pressure gauges and standard manometers. Particulate sampling was done using an EPA Method V Particulate Sampling System. Gas and particulate sampling was done during the testing to verify low concentrations of gas pollutants ($NO_x$ and $SO_x$) and low radionuclide carryover.

The simulated liquid wastes were prepared in a feed tank of 1900-liter capacity.

A Moyno slurry pump was used to pump the feed solution to the top of the spray dryer. Hot gas for the drying was produced by an excess air natural gas burner. The gas flow rate was 60 sc mm at 450° K. Under these conditions, 2.2 l/min (2.8 kg/min) of feed solution were dried. The temperature of the exit gas from the spray dryer was 65°–82° C. The dried product from the spray dryer entered the baghouse where it was collected at the bottom in 200-liter drums. The outlet gas from the baghouse traveled down an off-gas duct to an induced-draft fan and was then released through a stack.

The spray dryer was operated as follows. Hot gas from the burner using natural gas and an excess of air was passed through the heated gas spray dryer for a period of 4 hours to heat the spray dryer to the desired operating temperature. An atomizing wheel was installed in the spray dryer and compressed air was used as the atomizing gas. Flow through the atomizer was begun prior to the heat-up. The blower was actuated and the burner ignited. Distilled water was then fed to the nozzle through the liquid line. As the heated spray dryer approached operating temperature, the water and air flow to the nozzle was adjusted to the desired operating parameters. The spray dryer was then operated for ½ hour before the simulated waste was injected into the system. After the desired amount of simulated waste liquid or slurry was fed to the system, the liquid feed was again switched to distilled water. A summary of the spray dryer operating conditions is given in Table II and the off-gas composition is given in Table III.

TABLE II

| Quantity | Spray Dryer Operating Conditions: Simulated BWR Waste | Simulated PWR Waste | Resin-Filter Aid Waste |
|---|---|---|---|
| Feed rate, kg/min | 2.85 | 2.84 | 2.83 |
| Dil $H_2O$, lpm | 0.45 | 0.11 | 0.11 |
| Temp, °C. | | | |
| Dryer inlet | 185 | 189 | 186 |

TABLE II-continued

| Quantity | Spray Dryer Operating Conditions: Simulated BWR Waste | Simulated PWR Waste | Resin-Filter Aid Waste |
|---|---|---|---|
| Dryer outlet | 86 | 85 | 86 |
| Baghouse outlet | 73 | 76 | 77 |
| Wet bulb | 44 | 44 | 44 |
| Ambient | 11 | 13 | 11 |
| Gas flow, acmm[1] | 80.14 | 77.02 | 80.99 |
| Gas flow, scmm[2] | 61.73 | 59.75 | 62.58 |

[1]Actual cubic meters per minute
[2]Standard cubic meters per minute, where standard conditions are 293 K and 101.3 kPa

TABLE III

| Gas Species | Off-Gas Composition: BWR Waste (Simulated) | PWR Waste (Simulated) | Aid Waste (Resin-Filter) |
|---|---|---|---|
| $SO_2$, ppm | 0 | 0 | 2 |
| NO, ppm | 0 | 0 | 3 |
| $NO_x$, ppm | 0 | 0 | 3 |
| $H_2O$, vol % | 5.4 | 6.8 | 7.0 |

These results verified the expected advantage of the spray dryer in minimizing pollutant concentrations. When corrected for baseline concentrations, $SO_2$ was found to be 0–2 ppm in concentration. The NO was found to be ppm in the flue gas from the burner, and an additional 3 ppm of $NO_x$ was formed from the resin processing. These values were entirely in line with the expectation that nitrogen and sulfur are not oxidized in the spray drying process.

EXAMPLE 2

In order to demonstrate that corrosion and fission products are present as spray dried solids, Cs, I, Co, Mn and Fe concentrations at the baghouse exit were measured and compared with the corresponding concentrations at the baghouse inlet. The latter were calculated using the known value for the amount of material in the feed solution, the known gas flow rate in the system and the time of feeding. Since the system did not include a prefilter or HEPA filter as in the drawing, the sample of solids exiting the baghouse was collected on a glass fiber filter having a nominal particulate removal efficiency of 99.95%. The gas passing through the glass fiber filter was then passed through two chilled water scrubbers. The scrubber liquids were concentrated to a sample size of 20 g and the glass fiber filters were extracted with water. The solutions were analyzed for the desired substance using a spark-source mass spectrometer. The results of the analyses were then used in the calculation of the "Baghouse decontamination factor" (DF).

$$DF = \frac{\text{Activity of inlet stream}}{\text{Activity of exit stream}}$$

These results are shown in Table IV.

TABLE IV

Decontamination Factors for Spray Drying of Simulated Low-Level Radioactive Liquid Waste

| Measured and Calculated Quantities | Corrosion and Fission Products: Cs | I | Co | Mn | Fe |
|---|---|---|---|---|---|
| Simulated BWR Waste | | | | | |
| Conc, baghouse inlet, g/dscm[1] | $2.18 \times 10^{-2}$ | $2.18 \times 10^{-2}$ | $2.18 \times 10^{-2}$ | 0.0 | $2.18 \times 10^{-2}$ |
| Conc, baghouse exit, g/dscm | $1.52 \times 10^{-6}$ | $3.69 \times 10^{-5}$ | $4.72 \times 10^{-7}$ | — | $1.26 \times 10^{-5}$ |
| Baghouse decontamination factor | $1.4 \times 10^{4}$ | $5.9 \times 10^{2}$ | $4.6 \times 10^{4}$ | — | $1.7 \times 10^{3}$ |
| Simulated PWR Waste | | | | | |
| Conc, baghouse inlet, g/dscm | $2.33 \times 10^{-2}$ | $2.33 \times 10^{-2}$ | $2.33 \times 10^{-2}$ | $2.33 \times 10^{-2}$ | $2.33 \times 10^{-2}$ |
| Conc, baghouse exit, g/dscm | $2.89 \times 10^{-7}$ | $>6.6 \times 10^{-5}$ | $9.16 \times 10^{-7}$ | $8.14 \times 10^{-7}$ | $1.52 \times 10^{-5}$ |
| Baghouse decontamination factor | $8.1 \times 10^{4}$ | $<3.5 \times 10^{2}$ | $2.5 \times 10^{4}$ | $2.9 \times 10^{4}$ | $1.5 \times 10^{3}$ |
| Resin-Filter Aid Waste | | | | | |
| Conc, baghouse inlet, g/dscm | $1.98 \times 10^{-2}$ | $1.98 \times 10^{-2}$ | $1.98 \times 10^{-2}$ | $1.98 \times 10^{-2}$ | $2 \times 10^{-2}$ |
| Conc, baghouse exit, g/dscm | $3.02 \times 10^{-6}$ | $>7.6 \times 10^{-5}$ | $2.34 \times 10^{-7}$ | $5.41 \times 10^{-7}$ | $9.30 \times 10^{-6}$ |
| Baghouse decontamination factor | $6.6 \times 10^{3}$ | $<2.6 \times 10^{2}$ | $8.5 \times 10^{4}$ | $3.6 \times 10^{4}$ | $2.2 \times 10^{3}$ |

[1]Grams per dry standard cubic meter

The dry powder which is produced from spray drying radioactive liquid wastes has a low density that can be increased by vibration to give a so-called tap density. The density of the solid product can be further increased by compression of the powder by an applied force utilizing standard equipment, such as that used to compress solid radioactive wastes. Such compression is usually accomplished in standard 0.20 cubic meter (55 gallon) drums by application of a pressure of about 550 kPa (80 psi). Alternatively, the powders can be pressed into pellets by means of a pellet press. A pellet press requires a pressure of about 6.9 to 34.5 MPa (1000 to 5000 psi). The pellets produced can be loaded into a 0.20 cubic meter (55 gallon) drum realizing a maximum loading factor of about 60%, or the powder could be directly pressed into a reinforced drum giving the highest volume reduction factor.

The following example demonstrates the volume reductions obtained using the spray drying process of the present invention.

EXAMPLE 3

The extent of volume reduction using the system described in Example 1 was determined for each of the three non-radioactive simulated low-level wastes using various techniques for compressing the powder product. The results of this determination are shown in Table V.

TABLE V

| Quantity Composition | Volume Reduction Factors for Simulated Low-Level Radioactive Liquid Waste: Simulated BWR Waste 25 wt. % $Na_2SO_4$ | Simulated PWR Waste 12 wt. % $H_3BO_3$ | Resin-Filter Aid Waste 9 wt. % resins and filter aid (bone dry) |
|---|---|---|---|
| Liquid density, g/cm$^3$ | 1.24 | 1.12 | 1.05 |
| Volume of 1 kg of liquid, cm$^3$ | 800 | 890 | 950 |
| Density of solids, g/cm$^3$ | | | |
| Tap density | 0.66 | 0.47 | 0.34 |
| Density of solids pressed at 550 kPa (80 psi) | 0.78 | 0.61 | 0.55 |
| Density of solids pressed at 34.5 MPa (5000 psi) | 1.43 | 1.28 | 1.02 |
| Volume of solids from 1 kg of liquid, cm$^3$ | | | |
| Tap density | 380 | 255 | 280 |
| 550 kPa (80 psi) | 320 | 197 | 164 |
| 34.5 MPa (5000 psi) | 175 | 94 | 88 |
| Volume reduction factor | | | |
| Tap density | 2.1 | 3.5 | 3.4 |
| 550 kPa (80 psi) | 2.5 | 4.5 | 5.8 |
| 34.5 MPa (5000 psi) | 4.6 | 9.5 | 10.8 |
| 34.5 MPa (5000 psi) with 60% drum loading | 2.8 | 5.7 | 6.5 |

The process of the present invention is capable of reducing the volume of low-level radioactive wastes by a factor of about 2:1 to 3.5:1 while producing a dry, flowable radioactive solid product and a gaseous product which contains substantially no $NO_x$ or $SO_x$ and retaining volatile radionuclides in the solid product. It can be seen that greater volume reductions, up to about 10.8:1 can be realized by compression of the spray-dried powder obtained in the process of this invention.

It will, of course, be realized that various modifications can be made to the design and operation of the process of this invention without departing from the spirit thereof. For example, waste materials other than those specifically exemplified herein can be spray dried according to the process of this invention. The material to be treated can be introduced into the spray dryer using various single or multiple fluid spray nozzles or other forms of atomizers. Multiple nozzles or atomizers can be used, if desired. In addition, other gas-solid separation means can be used to separate the gaseous and solid products of the process. For example, electrostatic or metal filters or cyclones may be used. Other ways of treating the gaseous and solid products following separation can be used, if desired. Thus, while the principle, preferred design and mode of operation of the invention have been explained and what is now considered to represent its best embodiment has been illustrated and described, it should be understood that, within the scope of the appended claims, the invention can be practiced otherwise than as specifically illustrated and described.

What is claimed is:

1. A process for reducing the volume of a low-level radioactive liquid waste containing a compound of an element selected from the group consisting of I, Cs, Fe, Co and Mn which comprises:

introducing said low-level radioactive liquid waste in the form of a finely atomized spray into a spray drying zone and contacting it with a hot gas stream within said zone, said gas stream having a temperature in the range of about 45° to 300° C. sufficient to vaporize the water contained in said low-level radioactive liquid waste but insufficient to produce any oxidation products of said low-level radioactive liquid waste or to volatilize any radionuclides therefrom; and removing from said zone a dry, flowable solid radioactive product containing said compound of said element and a gaseous product comprising water vapor, said gaseous product containing substantially no $NO_x$, $SO_x$, or oxidation products of said liquid radioactive waste and no volatile compounds of I or Cs, the ratio of the volume of said low-level radioactive liquid waste to said dry, flowable solid radioactive product being in the range of about 2:1 to 3.5:1.

2. A process according to claim 1 wherein said low-level radioactive liquid waste comprises an aqueous solution.

3. A process according to claim 1 wherein said low-level radioactive liquid waste comprises an aqueous slurry.

4. A process according to claim 1 wherein said low-level radioactive liquid waste contains $Na_2SO_4$.

5. A process according to claim 1 wherein said low-level radioactive liquid waste contains boric acid or borate salts.

6. A process according to claim 1 wherein said low-level radioactive liquid waste contains an ion exchange resin.

7. A process according to claim 1 wherein said low-level radioactive liquid waste contains a filter aid.

8. A process according to claim 1 wherein said temperature is in the range of about 65° to 205° C.

9. A process according to claim 1 wherein said hot gas stream is produced by burning a fuel in an excess of an oxygen-containing gas.

10. A process according to claim 1 wherein said hot gas stream is produced by burning fuel oil in an excess of an oxygen-containing gas.

11. A process according to claim 1 wherein said hot gas stream is produced by burning natural gas in an excess of an oxygen-containing gas.

12. A process for reducing the volume of a liquid waste containing a compound of an element selected from the group consisting of I, Cs, Fe, Co and Mn which comprises:

burning a fuel with an excess of an oxygen-containing gas;

introducing the products obtained by burning said fuel into a spray drying zone to heat said spray drying zone to a temperature within the range of about 45° to 300° C.;

introducing a finely atomized spray of said liquid waste into the heated spray drying zone;

removing from said spray drying zone a dry, flowable solid product containing said compound of an element selected irom the group consisting of I, Cs, Fe, Co and Mn and a gaseous product containing substantially no oxidation products of said liquid waste and no volatile compound of I or Cs; and separating said dry, flowable solid product from said gaseous product;

the ratio of the volume of said liquid waste to said dry, flowable, solid product being in the range of about 2:1 to 3.5:1.

13. A process according to claim 12 wherein the temperature to which said zone is heated is in the range of about 65° to 250° C.

14. A process for reducing the volume of a low-level radioactive liquid waste which comprises:

burning a fuel with an excess of an oxygen-containing gas;

introducing the products obtained by burning said fuel into a spray drying zone to provide a spray drying zone uniformly heated to a temperature within the range of about 45° to 300° C.;

introducing a finely atomized spray of said low-level liquid radioactive waste into said uniformly heated spray drying zone;

removing from said uniformly heated spray drying zone a dry, flowable solid radioactive product and a gaseous non-radioactive product comprising water vapor, said gaseous non-radioactive product containing substantially no $NO_x$ or $SO_x$ and no volatile radionuclides, the ratio of the volume of said low-level liquid radioactive waste to said dry, flowable solid radioactive product being in the range of about 2:1 to 3.5:1;

and further reducing the volume of said dry, flowable solid radioactive product by applying to said dry, flowable solid radioactive product a pressure in the range of about 550 kPa to 34.5 MPa, to a ratio in the range of about 2.5:1 to 10.8:1.

15. A process according to claim 14 wherein said low-level radioactive liquid waste comprises an aqueous solution.

16. A process according to claim 14 wherein said low-level radioactive liquid waste comprises an aqueous slurry.

17. A process according to claim 14 wherein said low-level radioactive liquid waste contains $Na_2SO_4$.

18. A process according to claim 14 wherein said low-level radioactive liquid waste contains boric acid or borate salts.

19. A process according to claim 14 wherein said low-level radioactive liquid waste contains an ion exchange resin.

20. A process according to claim 14 wherein said low-level radioactive liquid waste contains a filter aid.

21. A process according to claim 14 wherein said temperature is in the range of about 65° to 205° C.

22. A process according to claim 14 wherein said hot gas stream is produced by burning fuel oil in an excess of an oxygen-containing gas.

23. A process according to claim 14 wherein said hot gas stream is produced by burning natural gas in an excess of an oxygen-containing gas.

* * * * *

UNITED STATES PATENT AND TRADEMARK OFFICE

CERTIFICATE OF CORRECTION

PATENT NO. : 4,579,069

DATED : April 1, 1986

INVENTOR(S) : Richard L. Gay et al

It is certified that error appears in the above-identified patent and that said Letters Patent is hereby corrected as shown below:

Column 11, line 37, delete "250°C." and insert --205°C.--.

Signed and Sealed this

*First* Day of *July 1986*

[SEAL]

*Attest:*

DONALD J. QUIGG

*Attesting Officer*

*Commissioner of Patents and Trademarks*